US009045849B2

(12) United States Patent
Cevikkalp et al.

(10) Patent No.: US 9,045,849 B2
(45) Date of Patent: Jun. 2, 2015

(54) WASHER/DRYER

(75) Inventors: Erman Cevikkalp, Istanbul (TR); Onur Boztas, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 1686 days.

(21) Appl. No.: 12/513,078

(22) PCT Filed: Oct. 30, 2007

(86) PCT No.: PCT/EP2007/061679

§ 371 (c)(1),
(2), (4) Date: Jan. 19, 2010

(87) PCT Pub. No.: WO2008/052988

PCT Pub. Date: May 8, 2008

(65) Prior Publication Data

US 2010/0132415 A1 Jun. 3, 2010

(30) Foreign Application Priority Data

Oct. 31, 2006 (TR) ..... TR2006/06050

(51) Int. Cl.
*D06F 35/00* (2006.01)
*D06F 39/00* (2006.01)
*D06F 39/14* (2006.01)

(52) U.S. Cl.
CPC ..... *D06F 39/00* (2013.01); *D06F 39/14* (2013.01)

(58) Field of Classification Search
CPC ..... D06F 39/14; D06F 39/00
USPC ..... 68/3 R, 13 R
See application file for complete search history.

(56) References Cited

U.S. PATENT DOCUMENTS

| | | | | |
|---|---|---|---|---|
| 6,508,085 | B1 * | 1/2003 | Byrne | 68/3 R |
| 2005/0257573 | A1 | 11/2005 | Henssler et al. | |
| 2008/0037275 | A1 | 2/2008 | Eblenkamp et al. | |
| 2008/0053161 | A1 | 3/2008 | Dahlke et al. | |

FOREIGN PATENT DOCUMENTS

| | | | |
|---|---|---|---|
| DE | 3843386 | A1 | 7/1990 |
| DE | 4026547 | A1 | 3/1992 |
| DE | 4220018 | A1 | 12/1993 |
| DE | 19649039 | C1 | 4/1998 |
| DE | 10316377 | B3 | 9/2004 |
| DE | 102004036672 | B3 | 12/2005 |
| EP | 1582619 | A | 10/2005 |
| JP | 10-263270 | A | 10/1998 |
| WO | 2005/93149 | A | 10/2005 |

OTHER PUBLICATIONS

Machine Translation of Abstract of DE 19649039 to Weber, Apr. 1998.*
Machine Translation of DE 19649039, Weber, Apr. 1998.*

* cited by examiner

*Primary Examiner* — Michael Barr
*Assistant Examiner* — Benjamin L Osterhout
(74) *Attorney, Agent, or Firm* — Venjuris, P.C.

(57) ABSTRACT

The present invention relates to a washer/dryer (1) comprising a drum (3) wherein the laundry is placed, a loading port (5) for loading and unloading the laundry from the drum (3), a door (6) that covers the loading port (5) and a transparent part (7) situated in the door (6) for monitoring the laundry and wherein the interior of the drum (3) is illuminated effectively by consuming a small amount of energy.

9 Claims, 1 Drawing Sheet

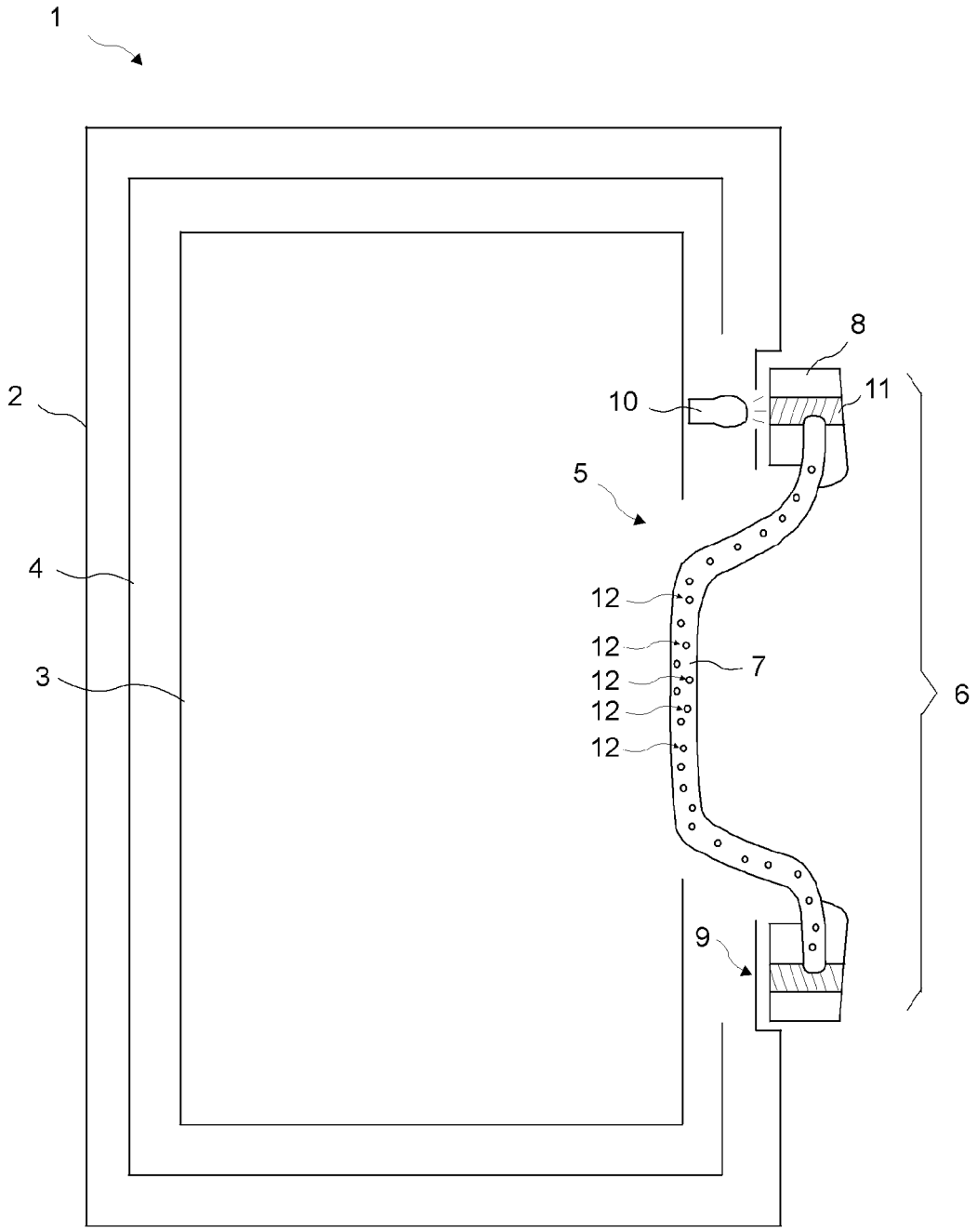
1
2
4
3
8
10
11
5
12
12
12
12
12
7
6
9

WASHER/DRYER

FIELD

The present invention relates to a washer/dryer wherein the interior of the drum is illuminated.

BACKGROUND

In washer/dryers, the interior of the drum wherein the laundry is placed is illuminated by means of illumination elements disposed on the tub bellows, the door or the tub inlet hose. In implementations wherein the illumination elements are disposed on the movable components, the interior of the drum cannot be illuminated effectively due to the disposed place and the illumination elements may be damaged. Illumination becomes costly and ineffective and more energy is consumed for an effective illumination.

In the German Patent Document No DE19649039 in a washing machine, the light received from a light source near the loading door hinge is delivered inside from the bull's eye window by means of the fiber optic light conductors disposed at the loading door and thus the interior of the tub is illuminated.

In the International Patent Document No WO2005093149, an illumination ring is described that is disposed on the edge of the loading door illuminating the area of the door that is disposed on the front side of the body.

In the German Patent Document No DE 4026547, an illuminating body is built into the water supply line. The light radiated from the illuminating body illuminates the inner space of the drum passing through the drum perforations.

In the German Patent Document No DE3843386, in a washing machine, a light guide delivers the light received from a light source towards the inside of the drum guiding through the concertina-type seal of the tub.

SUMMARY

The aim of the present invention is the realization of a washer/dryer wherein the interior of the drum is illuminated effectively by consuming a small amount of energy.

The washer/dryer realized in order to attain the aim of the present invention is explicated in the claims.

In the washer/dryer of the present invention, a light conductor is used that receives the light from a light source disposed on its body and delivers it to the side of the transparent part called as bull's eye window situated in the door that covers the loading port, for example the door glass and which preferably encircles the transparent part circumferentially. The transparent part is constituted of a concave structure that extends towards the inside of the drum and the light conductor delivers the light received from the light source by circumferentially encircling the transparent part. In the washer/dryer of the present invention, the light conductor is disposed inside the window frame since effective illumination of the drum interior is intended and cannot be viewed from the outside.

In the embodiment of the present invention, the transparent part comprises light piping dots that have a light piping effect.

In an embodiment of the present invention, the light piping dots are concentrated in the middle of the concave section of the transparent part and provide the light to diffuse into the drum for effective illumination.

In an embodiment of the present invention, the light piping dots are formed by engraving with a laser device inside the transparent part. In this embodiment, various designs or inscriptions can be formed in the transparent part to provide an esthetic appearance.

In an embodiment of the present invention, the light piping dots are formed on the surface of the transparent part by employing dot matrix. The dot matrix is formed by printing white dots by, for example, an ink-jet printer on the surface of the transparent part.

In an embodiment of the present invention, the light piping dots are formed of particles having luminescence property when light acts thereon that are aided to the material, e.g. glass, of the transparent part during production. The particles having luminescence property are produced of for example phosphorus or silicon based materials.

BRIEF DESCRIPTION OF THE DRAWING

The washer/dryer realized in order to attain the aim of the present invention is illustrated in the attached FIGURE, where:

FIG. 1 is the schematic view of a washer/dryer.

DETAILED DESCRIPTION

The elements illustrated in the FIGURE are numbered as follows:

1. Washer/dryer
2. Body
3. Drum
4. Tub
5. Loading port
6. Door
7. Transparent part
8. Frame
9. Frame housing
10. Light source
11. Light conductor
12. Light piping dots The washer/dryer (1) comprises a body (2), a drum (3) wherein the laundry is placed, a tub (4) wherein the drum (3) rotates, a loading port (5) for loading and unloading the laundry into/from the drum (3), a door (6) that covers the loading port (5), a transparent part (7) situated in the door (6) for monitoring the laundry, a frame (8) disposed around the transparent part (7) and a light source (10) assembled to the body (2) or the door (6).

The door (6) is secured with a hinge in front of the loading port (5) that is situated on the front wall of the washer/dryer (1) and is opened, closed in the axis of the hinge.

The transparent part (7) is produced of a light-transmitting material, for example of glass, and it has concave structure towards the inside of the drum (3) so that the laundry is prevented from being stuck in the bellows.

The washer/dryer (1) of the present invention comprises:

- a light conductor (11) disposed in the frame (8) and delivers the light received from the light source (10) to the side of the transparent part (7), and
- more than one light piping dots (12) that are spread on the surfaces or in the material of the transparent part (7), conveying the light received from the light conductor (11) providing illumination of the interior of the drum (3) by means of the transparent part (7).

In an embodiment of the present invention, the light conductor (11) is configured as a ring that circumferentially encircles the side of the transparent part (7) inside the frame (8) and delivers light from all the periphery of the transparent part (7) towards the interior.

In another embodiment of the present invention, the light piping dots (12) are spread intensively in the middle of the concave section of the transparent part (7) and convey the light received from the light conductor (11) directing from the middle of the concave section of the transparent part (7) into the drum (3). Thus the light is delivered to the interior region of the drum (3) to be illuminated effectively by radiating from the middle of the concave section of the transparent part (7).

The beams emitted from the light source (10) illuminate the light conductor (11) that preferably encircles the periphery of the transparent part (7) like a ring. The light conductor (11) remaining within the frame (8) is not visible from the outside and the interior of the drum (3) can be conveniently monitored without disrupting the vision of the user since it does not have outward glow effect. The beams emitted from the light conductor (11) enter inside from the side of the transparent part (7) and directed towards the interior of the drum (3) by means of the light piping dots (12) spread in the transparent part (7).

In an embodiment of the present invention, the light piping dots (12) are spread homogeneously to the entirety of the transparent part (7) and the interior of the drum (3) is also illuminated homogeneously.

In an embodiment of the present invention, the light piping dots (12) are formed by engraving with a laser device inside the transparent part (7). In this embodiment, various designs or inscriptions can be formed in the transparent part (7) to provide an esthetic appearance.

In an embodiment of the present invention, the light piping dots (12) are formed on the surface of the transparent part (7) by employing dot matrix. The dot matrix is formed by tracing white dots with for example an ink-jet printer on the surface of the transparent part (7).

In an embodiment of the present invention, the light piping dots (12) are formed of particles having luminescence property when light acts thereon that are added to the material of the transparent part (7) during production. The particles having luminescence property are produced of for example phosphorus or silicon based materials and added to the material, e.g. glass, of the transparent part (7) during production.

In an embodiment of the present invention, the light source (10) is disposed inside the frame (8) and directly illuminates the light conductor (11) that is also disposed within the frame (8).

In an embodiment of the present invention, the washer/dryer (1) comprises a frame housing (9) situated on the body (2), on which the frame (8) is seated when the door (6) is closed. In this embodiment, the light source (10) is disposed on the frame housing (9) and when the frame (8) is seated on the frame housing (9) by closing the door (6), the light conductor (11) situated in the frame (8) is illuminated.

By means of the present invention, the interior of the drum (3) in the washer/dryer (1) is effectively illuminated and the transparent part (7) of the door (6) providing illumination presents an esthetic appearance.

The invention claimed is:

1. A washer/dryer (1) comprising a body (2), a drum (3) wherein the laundry is placed, a loading port (5) for loading and unloading the laundry from the drum (3), a door (6) that covers the loading port (5), a transparent part (7) situated in the door (6) for monitoring the laundry, a frame (8) disposed around the transparent part (7) and a light source (10) assembled to the body (2) or the door (6), and a light conductor (11) disposed in the frame (8) and delivering the light received from the light source (10) to the side of the transparent part (7), and more than one light piping dots (12) that are spread on the surfaces or in the material of the transparent part (7), conveying the light received from the light conductor (11) providing illumination of the interior of the drum (3) by means of the transparent part (7).

2. The washer/dryer as in claim 1, wherein the light conductor (11) configured as a ring that circumferentially encircles the side of the transparent part (7) inside the frame (8).

3. The washer/dryer (1) as in claim 1 or 2, wherein the light piping dots (12) that are spread intensively in the middle of the concave section of the transparent part (7) extending into the drum (3) and convey the light received from the light conductor (11) directing from the middle of the concave section of the transparent part (7) into the drum (3).

4. The washer/dryer (1) as in claim 1 or 2, characterized by wherein the light piping dots (12) that are spread homogeneously to the entirety of the transparent part (7).

5. The washer/dryer (1) as in claim 1 or 2, wherein the light piping dots (12) that are formed by engraving with a laser device in the transparent part (7).

6. The washer/dryer (1) as in claim 1 or 2, wherein the light piping dots (12) that are formed by employing dot matrix on the surface of the transparent part (7).

7. The washer/dryer (1) as in claim 1 or 2, wherein the light piping dots (12) that are formed of particles having luminescence property when light acts thereon that are added to the material of the transparent part (7) during production.

8. The washer/dryer (1) as in claim 1 or 2, wherein the light source (10) disposed inside the frame (8).

9. The washer/dryer (1) as in claim 1 or 2, further comprising a frame housing (9) situated on the body (2), on which the frame (8) is seated when the door (6) is closed and the light source (10) disposed on the frame housing (9) that illuminates the light conductor (11) situated in the frame (8) when the frame (8) is seated on the frame housing (9) by closing the door (6).

* * * * *